US005389428A

United States Patent [19]

Fleming et al.

[11] Patent Number: 5,389,428

[45] Date of Patent: Feb. 14, 1995

[54] SINTERED CERAMIC COMPONENTS AND METHOD FOR MAKING SAME

[75] Inventors: Debra A. Fleming, Lake Hiawatha, N.J.; Gideon S. Grader, Haifa, Israel; David W. Johnson, Jr., Bedminster, N.J.; Henry M. O'Bryan, Jr., Plainfield, N.J.; Warren W. Rhodes, Raritan, N.J.

[73] Assignee: AT&T Corp., Murray Hill, N.J.

[21] Appl. No.: 987,515

[22] Filed: Dec. 8, 1992

[51] Int. Cl.[6] ..... H01F 41/02

[52] U.S. Cl. ..... 428/209; 365/122; 428/472; 428/697; 428/699; 428/701; 428/702; 428/900

[58] Field of Search ..... 428/900, 472, 697, 701, 428/702, 699, 209; 360/126, 120; 365/122

[56] References Cited

U.S. PATENT DOCUMENTS

| | | | |
|---|---|---|---|
| 4,388,131 | 6/1983 | Unger et al. | 264/58 |
| 4,841,399 | 6/1989 | Kitada et al. | 360/113 |
| 4,901,179 | 2/1990 | Satomi et al. | 360/126 |
| 5,097,391 | 3/1992 | Nomura et al. | 361/321 |

FOREIGN PATENT DOCUMENTS

| | | |
|---|---|---|
| 0279581 | 8/1988 | European Pat. Off. . |
| 0512718 | 11/1992 | European Pat. Off. . |
| 0550974 | 7/1993 | European Pat. Off. . |

*Primary Examiner*—Archene Turner

*Attorney, Agent, or Firm*—Glen E. Books; Margaret A. Burke

[57] ABSTRACT

This invention is predicated upon applicants' discovery that conventional techniques for minimizing metal loss from sintered ceramic materials are not adequate in the fabrication of small ceramic components such as multilayer monolithic magnetic devices wherein a magnetic core is substantially surrounded by an insulating housing. Applicants have determined that this metal loss problem can be solved by providing the component with a housing layer having an appropriate concentration of metal. Specifically, if the insulating housing material around the magnetic core has, during the high temperature firing, the same partial pressure of metal as the magnetic core material, there is no net loss of metal from the core. In a preferred embodiment, loss of zinc from a MnZn ferrite core is compensated by providing a housing of NiZn ferrite or zinc aluminate with appropriate Zn concentrations. Similar considerations apply to other ceramic components.

4 Claims, 3 Drawing Sheets

EFFECT OF Zn LOSS ON CORE PERMEABILITY

SINTERED CERAMIC COMPONENTS AND METHOD FOR MAKING SAME

FIELD OF THE INVENTION

This invention relates to sintered ceramic components such as capacitors and multilayer magnetic transformers and inductors; and, in particular, to improved materials and methods for making such components.

BACKGROUND OF THE INVENTION

Sintered ceramic materials are used in a wide variety of electronic and optical components including capacitors, magnetic devices such as transformers and inductors, and optoelectronic devices. As these components become smaller, maintaining compositional integrity becomes increasingly important. This is particularly true with respect to metal-containing constituents which tend to volatilize in the sintering process. Magnetic devices such as transformers and inductors illustrate the problem to which the invention is directed. Such devices are essential elements in a wide variety of circuits requiring energy storage and conversion, impedance matching, filtering, EMI suppression, voltage and current transformation, and resonance. As historically constructed, these devices tended to be bulky, heavy and expensive as compared with other circuit components. Manual operations such as winding conductive wire around magnetic cores dominated production costs.

A new approach to the fabrication of such devices was described in U.S. patent application Ser. No. 07/695653 entitled "Multilayer Monolithic Magnetic Components and Method of Making Same" filed by Grader et al on May 2, 1991, and assigned to applicants' assignee. In the Grader et al approach ceramic powders are mixed with organic binders to form magnetic and insulating (non-magnetic) green ceramic tapes, respectively. A magnetic device is made by forming layers having suitable two-dimensional patterns of magnetic and insulating regions and stacking the layers to form a structure with well-defined magnetic and insulating regions. Conductors are printed on (or inserted into) the insulating regions as needed, and the resulting structure is laminated under low pressure in the range 500–3000 psi at a temperature of 60°–80° C. The laminated structure is fired at a temperature between 800° to 1400° C. to form a co-tired composite structure.

A variation of this approach was described in U.S. patent application Ser. No. 07/818669 entitled "Improved Method For Making Multilayer Magnetic Components" filed by Fleming et al. on Jan. 9, 1992, and assigned to applicants' assignee. In accordance with Fleming et al., cracking and magnetic degradation is reduced by forming green ceramic layers having patterns of magnetic and insulating (non-magnetic) regions separated by regions that are removable during sintering. When the green layers are stacked, layers of removable material are disposed between magnetic regions and insulating regions so as to produce upon sintering a magnetic core within an insulating body wherein the core is substantially completely surrounded by a thin layer of free space. In either approach, the preferred materials for the magnetic layers are metal-containing ferrites such as MnZn ferrites. The insulating (non-magnetic) material can be a compatible insulating ceramic material such as Ni ferrite or alumina.

A difficulty that arises in the fabrication of these devices is the tendency of metal or metal oxide constituents in the magnetic material to volatilize during sintering, thereby degrading the magnetic properties of the sintered material. Such loss of metal or metal oxide will be referred to as "metal loss". The conventional method of minimizing metal loss in ceramics is to fire the parts in the presence of sufficient quantity of the self-same material so that volatilization is inhibited and compensated. Applicants discovered, however, that this conventional method is of little value in fabricating small multilayer magnetic components where a layer of insulating material typically surrounds the magnetic core. This is because external metal vapor typically cannot penetrate the insulating material to reach the magnetic core. Moreover, because these components are typically small (a fraction of a cubic cm), the surface to volume ratio is large, aggravating the rate of metal loss. While it was initially believed that metal loss would be limited because the magnetic cores were housed within hermetic boxes of insulating materials, in reality the insulating materials acted as sinks for the metal and aggravated the loss. Accordingly, there is a need for a new way of minimizing metal loss during the fabrication of multilayer ceramic components.

SUMMARY OF THE INVENTION

This invention is predicated upon applicants' discovery that conventional techniques for minimizing metal loss from sintered ceramic materials are not adequate in the fabrication of small ceramic components such as multilayer monolithic magnetic devices wherein a magnetic core is substantially surrounded by an insulating housing. Applicants have determined that this metal loss problem can be solved by providing the component with a housing layer having an appropriate concentration of metal. Specifically, if the insulating housing material around the magnetic core has, during the high temperature firing, the same partial pressure of metal as the magnetic core material, there is no net loss of metal from the core. In a preferred embodiment, loss of zinc from a MnZn ferrite core is compensated by providing a housing of NiZn ferrite or zinc aluminate with appropriate Zn concentrations. Similar considerations apply to other ceramic components.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and, except for graphical illustrations, are not to scale.

DETAILED DESCRIPTION

Figure 1:
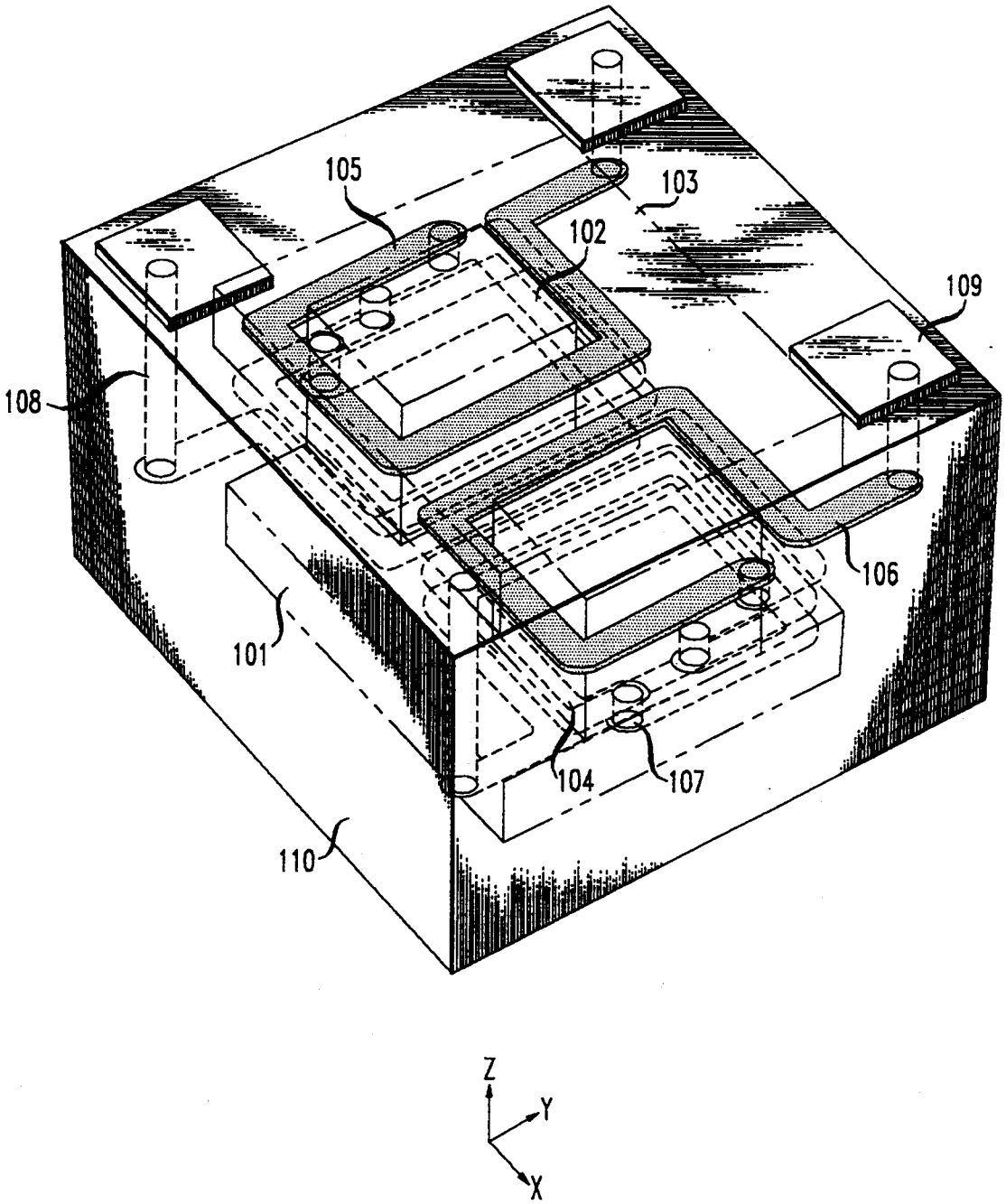
FIG. 1 is a three-dimensional, see-through drawing of a typical magnetic device to which the invention applies.

FIG. 1 is a drawing useful in understanding the problem to which the invention is directed and in illustrating the type of device to which the invention applies. Specifically, FIG. 1 is a three-dimensional, see-through drawing of a typical multilayer magnetic component of the type described in the aforementioned Fleming et al application.

This device is constructed as a multiple winding transformer having a continuous magnetic core analogous to a toroid. The core comprises four sections 101 to 104, each of which is constructed from a plurality of high magnetic permeability ceramic green tape layers. Sections 102 and 104 are circumscribed by conductive windings 105 and 106, respectively. These windings form the primary and secondary of a transformer. Alternatively, the windings could be connected in series so that the structure functions as a multiple turn inductor. Windings 105 and 106 are formed by printing pairs of conductor turns onto a plurality of insulating non-magnetic ceramic green tape layers, each insulating non-magnetic layer having suitable apertures for containing the sections of magnetic green tape layered inserts and peripheral regions of removable material disposed between the non-magnetic material and the magnetic material. The turns printed on each layer are connected to turns of the other layers with conductive vias 107 (i.e. through holes filled with conductive material). Additional insulating non-magnetic layers are used to contain sections 101 and 103 of the magnetic tape sections and to form the top and bottom structure of the component. In each instance regions of removable material (not shown in FIG. 1) have been provided to separate the magnetic and non-magnetic regions. Conductive vias 108 are used to connect the ends of windings 105 and 106 to connector pads 109 on the top surface of the device. The insulating non-magnetic regions of the structure are denoted by 110. Current excitation of the windings 105 and 106 produces a magnetic flux in the closed magnetic path defined by sections 101–104 of the toroidal core. The fluxpath in this embodiment is in a vertical XZ plane.

In the fabrication process the regions of high permeability material and low permeability material are separated by regions of removable material. A removable material is one which dissipates prior to completion of sintering by evaporation, sublimation, oxidation or pyrolysis. Such materials include polyethylene, cellulose, starch, nitrocellulose, and carbon. Particles of these materials can be mixed with the same kinds of organic binders as the ferrites and can be formed into tapes of equal thickness.

Figure 2:
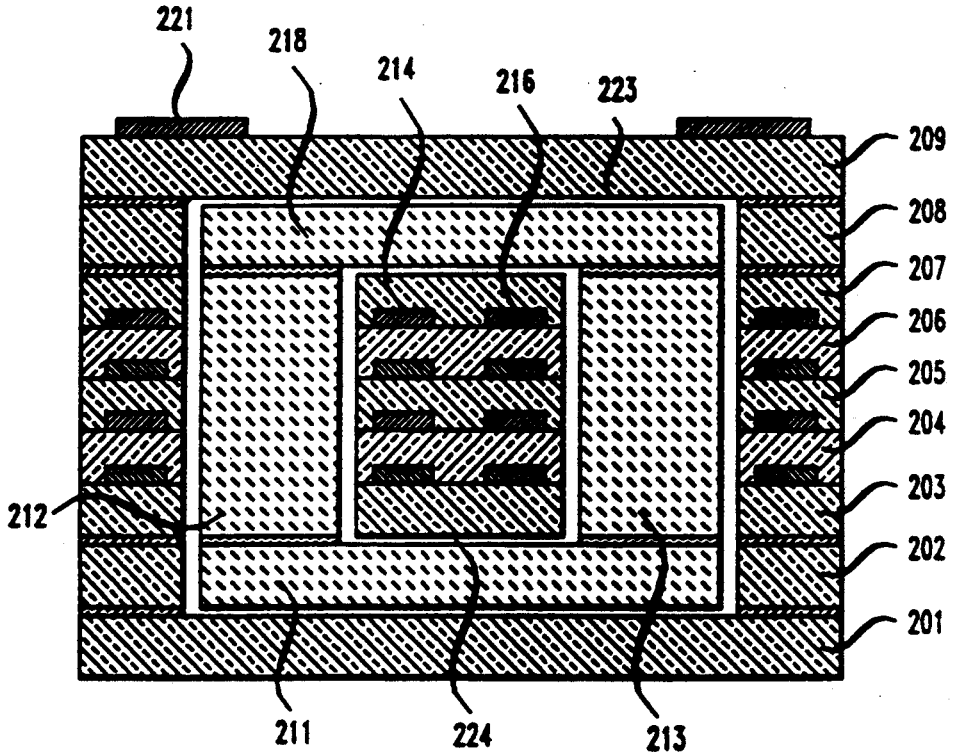
FIG. 2 is a schematic cross section of the device of FIG. 1.

The effect of separating the magnetic and non-magnetic regions with removable material is to produce a device with physically separated regions as shown in FIG. 2. Specifically, FIG. 2 is a cross sectional view parallel to the XZ plane of the FIG. 1 device showing the individual tape layers and the spacing between regions. Member 201 is an insulating non-magnetic tape layer. Member 202 includes layers of non-magnetic tape each having an aperture within which a magnetic section 211 (shown as 101 in FIG. 1) is disposed in spaced apart relation to the insulating tape. The number of layers used to form members 202 and 211 is determined by the required magnetic cross section area. Members 203–207 forming the next section includes single layers of insulating non-magnetic tape having apertures for containing magnetic material sections 212 and 213 (shown as members 102 and 104 in FIG. 1). Members 203 through 206 contain conductor turns 214 and 216 printed on each individual layer. In this particular illustration a four turn winding is shown. It is to be understood that many added turns are possible by increasing the number of layers and by printing multiple concentric turns on each layer. Member 208 is similar to member 202 and includes an insulating non-magnetic tape having an aperture containing a spaced magnetic insert 218. The top number 209 is an insulating non-magnetic tape layer. Connector pads 221 are printed on the top surface to facilitate electrical connection to the windings.

The result of separating the magnetic and non-magnetic green ceramics with regions of removable material is the formation of a high permeability core within the insulating ceramic but physically separated from the insulating material by a spacing regions 223 and 224. This spacing occurs because during the heat treatment, the organic binders which hold the particles in the tapes together are "burned out". During the same heat treatment, the removable tape disintegrates into vapor species and leaves the structure through the pores between the yet unsintered ceramic particles. Since, in some applications, it may be undesirable to have a completely free floating core, a plurality of small posts or tabs (not shown) of nonremovable material such as either magnetic or non-magnetic ceramic material can be inserted into the removable tape to anchor the core to the insulating housing.

As can be seen, the magnetic material core of this device is substantially completely surrounded by the insulating material housing. Consequently, the conventional method of preventing zinc loss by sintering the green structure in an enclosure of the same magnetic material does not work. The insulating housing intervenes between the inner magnetic core and the external zinc vapor. Nor, as anticipated, does the closely fitting insulating housing limit the zinc loss by acting as a hermetic box. Instead the insulating material was found to act as a zinc sink, absorbing or reacting with the zinc at the high sintering temperatures. The result was serious depletion of zinc from the surface of the magnetic core and degradation of the magnetic properties of the core.

Figure 3:
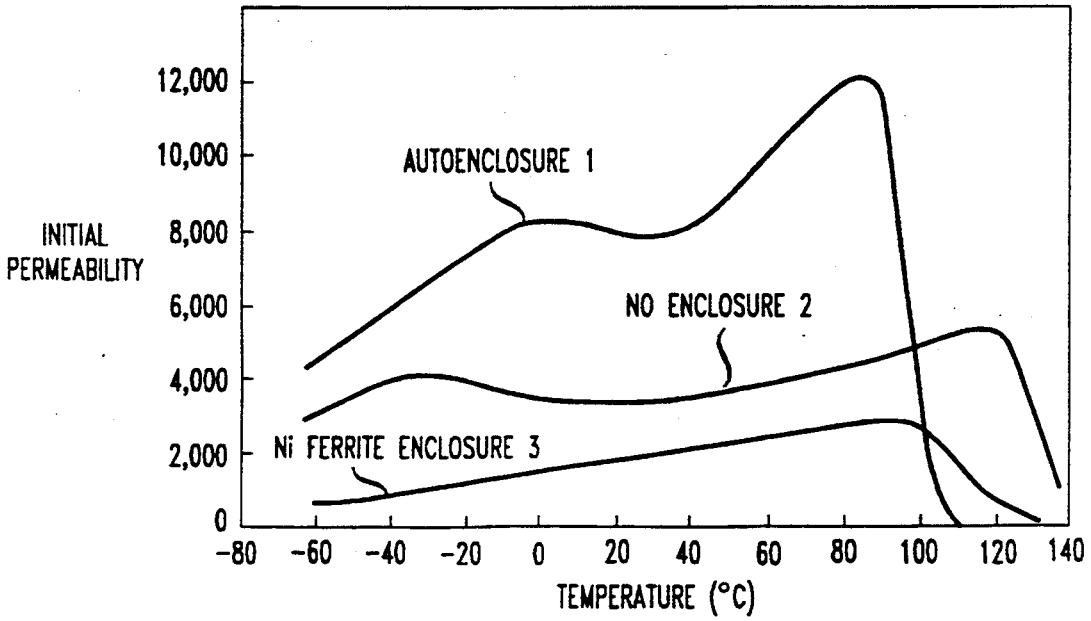
FIG. 3 is a graphical illustration showing the effect of zinc loss on the magnetic properties of Mn, Zn devices fabricated in different ways.

FIG. 3 is a graphical illustration which shows the effect of zinc loss on the magnetic properties of magnetic cores made in three different ways. Specifically, curve 1 plots the permeability of an MnZn ferrite core sintered within an enclosure of the same MnZn ferrite. Zinc loss from such a core is minimal and high permeability is displayed at ordinary operating temperatures. Curve 2 is a similar plot of a similar core sintered with no enclosure. Permeability levels are reduced to less than half those of the Curve 1 core. Curve 3 is a plot for a similar core sintered within a Ni ferrite enclosure. Permeability levels are reduced even further than for the non-enclosed core because the Ni ferrite acts as a zinc sink.

To solve this problem applicants determined to provide the insulating material with zinc in order to compensate zinc loss from the magnetic material. Specifically, applicants doped or composed insulating housing materials to have a sufficient concentration of zinc that the zinc partial pressure of the insulating material at sintering temperature is the same as the zinc partial pressure of the magnetic material. One preferred set of materials was $MnZnFe_2O_4$ for the magnetic material core and NiZn ferrite for the insulating material housing.

Figure 4:
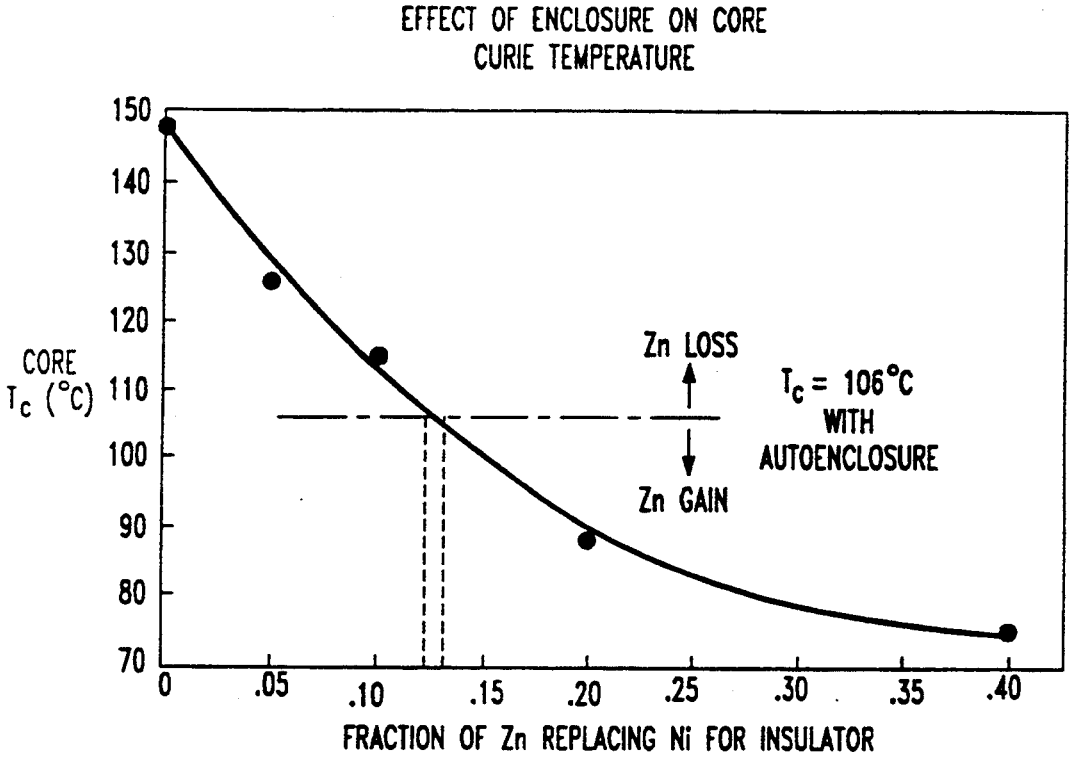
FIG. 4 is a graphical illustration showing the effect on the Curie temperature of a surrounded magnetic core achieved by replacing Ni with Zn in the insulating housing.

Since Zn ferrite and Ni ferrite make a solid solution, it is relatively easy to control the Zn/Ni ratio. In order to determine the ideal composition for Ni, Zn ferrite, applicants prepared a series of these ferrites with a range of Zn/Ni ratios, fabricated the ferrites into sheets of green tape and used the sheets to enclose toroidal shaped samples of the magnetic material (MnZn ferrite). These samples were then fired, and the resulting cores were analyzed as follows:

1. The Curie temperature Tc of each fired core was measured. Tc was also measured for a reference sample core sintered in an enclosure of the same core material (an autoenclosed core). The Tc of cores fired in enclosures of various NiZn ferrites were measured and a composition with optimum Zn/Ni ratio was determined as that which had the same Tc as the autoenclosed core. FIG. 4 illustrates one set of experimental data with a maximum sintering temperature of 1385° C. in a 30% $O_2$ in nitrogen atmosphere.

2. The magnetic permeability of the fired cores were measured. The Zn/Ni ratio versus permeability curve went through a maximum at the optimum Zn/Ni ratio as determined by the Curie temperature measurements.

3. The cores of the magnetic ferrites fired in the various NiZn ferrites were chemically analyzed using Energy Dispersive X-ray Analysis (EDXA) in a scanning electron microscope. The cores were sectioned so that the Zn content close to the surface could be compared with that deep within the core, and the insulating material having the optimum Zn/Ni ratio had the same Zn content at the surface as it had deep within.

4. The weight of cores fired in the various NiZn ferrite enclosures was monitored to determine if weight had been gained or lost. For the optimum Zn/Ni ratio, there was no measurable weight loss or weight gain.

Of these tests the Curie temperature Tc was believed the most sensitive. FIG. 4 is a graph plotting core Tc versus the molar fraction of Zn replacing Ni in the insulating enclosure. As can be seen, for this particular MnZn ferrite composition and firing conditions the optimum fraction of Zn replacing Ni in the insulating material is within the range 0.10 to 0.15 and is preferably about 0.125. More generally, the Zn/Ni mole fraction is in the range 0.05 to 0.25.

Figure 5:
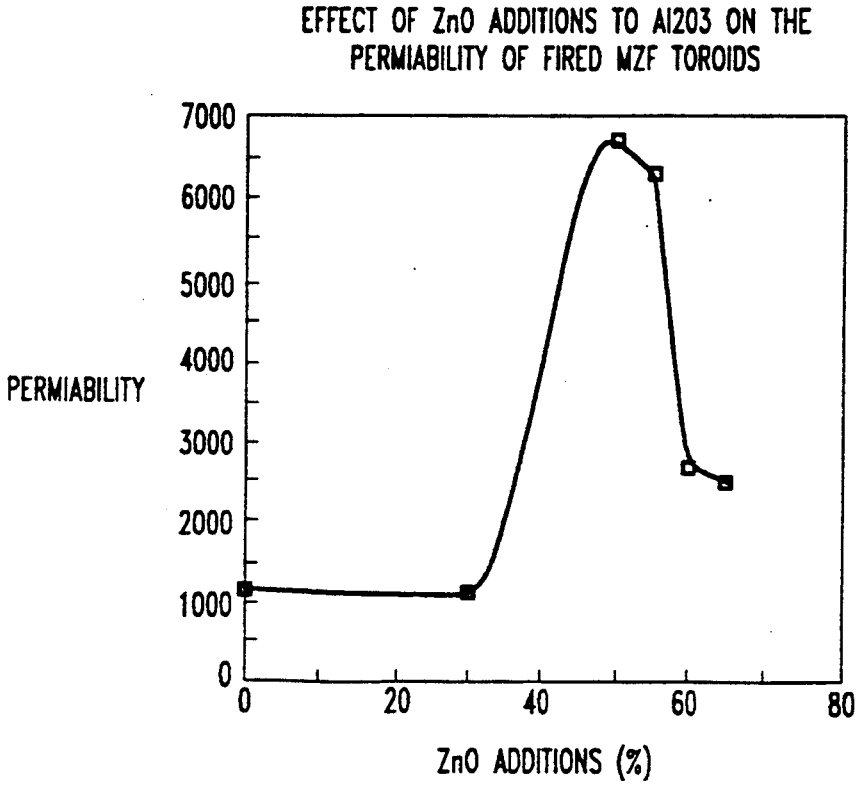
FIG. 5 is a graphical illustration showing the effect on the magnetic permeability of a surrounded core achieved by adding ZnO to $Al_2O_3$ in the insulating housing.

As a second example of a suitable insulating material for use with MnZn ferrite cores, applicants doped alumina ($Al_2O_3$) with various mole percents of ultrafine zinc oxide particles, formed green layers of the insulating material and fired toroids of MnZn ferrite magnetic material enclosed between sheets of the insulating material. FIG. 5 graphically illustrates the magnetic permeability of the sintered cores as a function of the percent of ZnO added. As can be seen the magnetic permeability of the fired cores achieves a maximum with about 50 mole percent of ZnO added to the alumina to form a zinc aluminate.

The preferred insulating material can be made by preparing ultrafine ZnO, mixing the ZnO with $Al_2O_3$ and up to 4 mole percent total of $TiO_2$ and CuO to promote densification, and forming a ceramic. Specifically, ultrafine ZnO can be formed by precipitating zinc oxalate out of saturated Zn $(NO_3)_2$ solution, filtering the precipitate to yield a submicron powder and convening the powder to ZnO by heating to about 400° C. The ZnO and alumina powder are first milled and suspended. The $TiO_2$ and CuO dopants and tetraethyl ammonium hydroxide (TEAH) are added to the suspension which is then mixed for about 5 minutes and filtered. The result is dried to a powder, calcined at 700° C. and then milled. The milled powder can be formed into a spinel ceramic by pressing and firing to above 1385° C. For some ferrite cores, it may be desirable to lower the partial pressure of Zn and this can be accomplished by substituting Mg for Zn.

Many other examples exist as possible Zn containing insulators to use with MnZn ferrite cores. For instance, ceramics based on $SnZn_2O_4$ are useful for lower temperature firing applications, and the partial pressure of Zn can be modified to suit the particular need of the ferrite core by partial substitution for Zn of a similarly sized ion of the same valence having a low vapor pressure at the sintering temperature. Mg is one example of such a substitute. As another example, even lower sintering temperature insulators can be made using composites of ceramic particles mixed with glass particles. These composites can sinter at low temperatures to a ceramic when the glass melts to hold together the ceramic particles. For the inventive application, the glass phase can contain zinc oxide as one of the glass forming constituents, and the zinc oxide content can be increased or decreased to obtain the desired partial pressure of Zn.

This solution of adding metal to the region surrounding the core is particularly attractive for the fabrication of small devices (less than 1 $cm^3$) since it not only eliminates metal loss from these small parts but also allows the devices to be fired in furnaces without the usual need for box enclosures or highly loaded large kilns, something which is difficult to achieve with small pans. This approach is useful for passive devices integrated within a ceramic substrate or package.

It is to be understood that tile above-described embodiments are illustrative of only a few of the many possible specific embodiments which can represent applications of the principles of the invention. For example, the same approach can be used with devices using other magnetic ceramics such as lithium ferrite where Li is the volatile metal, with capacitive devices using dielectric ceramics such as lead magnesium niobate where lead is the volatile metal, with piezoelectric devices using piezoelectric ceramics such as lead zirconate titanate where lead is the volatile metal and in optical devices using electrooptic materials such as lithium niobate where lithium is the volatile metal. The above examples of volatile metals or metal oxides is not exhaustive and ceramics containing other materials such as Na, K, Rb, Cs, Cd, Bi, P, As, Sb, Bi, W, S, Se, and Te often need some protection against loss of these volatile species. Numerous and Varied other arrangements can be devised by those skilled in tile art without departing from the spirit and scope of the invention.

We claim:

1. In a multilayer magnetic device of the type comprising layers having patterns of metal-containing magnetic material regions and insulating material regions stacked to form a structure comprising a magnetic material core substantially surrounded by an insulating material housing, said metal-containing magnetic material normally subject to metal loss during sintering, the improvement wherein: said insulating material comprises metal of the type included in said magnetic material at a concentration level such that at sintering temperatures there is no net loss or gain of metal from said magnetic material.

2. The device of claim 1 wherein said magnetic material is MnZn ferrite subject to zinc loss during sintering and said insulating material is NiZn ferrite.

3. The device of claim 2 wherein said Ni Zn ferrite has a Zn/Ni mole fraction in the range 0.05 to 0.25.

4. The multilayer magnetic device of claim 1 wherein said magnetic material is MnZn ferrite subject to zinc loss during sintering and said insulating material comprises a zinc aluminate.

* * * * *

UNITED STATES PATENT AND TRADEMARK OFFICE

CERTIFICATE OF CORRECTION

PATENT NO. : 5,389,428

DATED : February 14, 1995

INVENTOR(S) : Debra A. Fleming et al

It is certified that error appears in the above-indentified patent and that said Letters Patent is hereby corrected as shown below:

On the title page, Inventors should read --Debra A. Fleming, Lake Hiawatha, N.J.; Gideon S. Grader, Haifa, Israel; David W. Johnson, Jr., Bedminster, N.J.; Henry M. O'Bryan, Jr., Plainfield, N.J.; Warren W. Rhodes, Raritan, N.J.; Apurba Roy, Rockwall, TX; John Thomson, Jr., Spring Lake, N.J.--

Signed and Sealed this

Twenty-third Day of May, 1995

*Attest:*

Bruce Lehman

BRUCE LEHMAN

*Attesting Officer*

*Commissioner of Patents and Trademarks*